United States Patent [19]

Yamada et al.

[11] 4,173,518

[45] Nov. 6, 1979

[54] ELECTRODES FOR ALUMINUM REDUCTION CELLS

[75] Inventors: Koichi Yamada; Tadanori Hashimoto; Kazuo Horinouchi, all of Niihama, Japan

[73] Assignee: Sumitomo Aluminum Smelting Company, Limited, Osaka, Japan

[21] Appl. No.: 845,287

[22] Filed: Oct. 25, 1977

Related U.S. Application Data

[63] Continuation of Ser. No. 624,004, Oct. 20, 1975, abandoned.

[30] Foreign Application Priority Data

Oct. 23, 1974 [JP] Japan ..... 49-122916
May 7, 1975 [JP] Japan ..... 50-55015

[51] Int. Cl.[2] ..... C25C 3/06; C25C 7/02; C25B 11/04

[52] U.S. Cl. ..... 204/67; 204/290 R; 204/290 F; 204/291

[58] Field of Search ..... 204/290 F, 67, 291, 204/290 R

[56] References Cited

U.S. PATENT DOCUMENTS

| | | | |
|---|---|---|---|
| 3,645,862 | 2/1972 | Cotton et al. | 204/56 R |
| 3,649,485 | 3/1972 | Chisholm | 204/95 |
| 3,711,397 | 1/1973 | Martinsons | 204/290 L |
| 3,718,550 | 2/1973 | Klein | 204/67 |
| 3,775,284 | 11/1973 | Bennett et al. | 204/290 F |
| 3,801,490 | 4/1974 | Welch | 204/290 F |
| 3,804,740 | 4/1974 | Welch | 204/290 R |
| 3,839,181 | 10/1974 | Degueldre et al. | 204/290 F |
| 3,849,282 | 11/1974 | Degueldre et al. | 204/290 F |
| 3,878,083 | 4/1975 | De Nora et al. | 204/290 F |
| 3,948,751 | 4/1976 | Bianchi et al. | 204/290 F |
| 3,960,678 | 6/1976 | Alder | 204/67 |
| 4,039,401 | 8/1977 | Yamada et al. | 204/67 |

FOREIGN PATENT DOCUMENTS

| | | | |
|---|---|---|---|
| 1164477 | 9/1969 | United Kingdom | 204/290 F |

OTHER PUBLICATIONS

Electronic-Ceramics (Japan), vol. 3, No. 7, pp. 37–40, Jul. 1972.

Belyaev et al., Chem. Abs., vol. 31, col. 8384 (5).

*Primary Examiner*—F. C. Edmundson

*Attorney, Agent, or Firm*—Stevens, Davis, Miller & Mosher

[57] ABSTRACT

An electrode for aluminum reduction cells wherein an electrode base, at least in that portion which is brought into contact with a molten salt bath, is coated with a composition comprising at least 50% by weight of electronic conductive oxide ceramics, or said portion of the electrode is made of said composition.

26 Claims, 3 Drawing Figures

ELECTRODES FOR ALUMINUM REDUCTION CELLS

Figure 1:
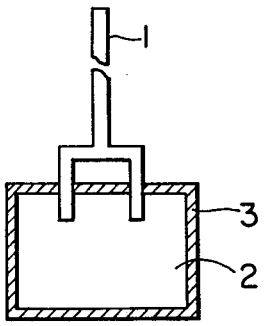

This is a continuation of application Ser. No. 624,004 filed Oct. 20, 1975, now abandoned.

The present invention relates to an electrode for use in manufacturing aluminum by molten salt electrolysis of aluminum oxide. More particularly, it relates to an electrode, specifically to an anode for use in aluminum reduction cells.

It has been known to manufacture aluminum by molten salt electrolysis of aluminum oxide dissolved in a bath of composite fluoride of aluminum and sodium ($AlF_3.3NaF$) or so-called cryolite, using a carbon anode. Usually, the above electrolysis process is conducted at about 900°-1000° C. When the carbon anode is used to manufacture aluminum, the carbon anode is consumed by oxidation due to oxygen produced by the decomposition of aluminum oxide by the amount of about 330 kg theoretically and 400-450 kg actually, per ton of aluminum. For this reason, it is necessary to continuously adjust the position of the electrode to maintain it at a constant level, and it is also required to replace the anode before it is completely consumed. These are operational and economical defects.

As an approach to overcome the above difficulties, various non-consumable anodes have been recently developed. For example, it has been known to use an oxygen ion-conductive anode consisting mainly of zirconium oxide (British Pat. No. 1,152,124). This method, however, is disadvantageous in that it requires an apparatus for removing oxygen produced and the operation is complex. It has also been proposed to use an anode consisting of an electronic conductive metal oxide comprising at least 80% by weight of tin oxide (British Pat. No. 1,295,117). This method is also disadvantageous in that the anode has poor chemical resistance to the molten salt.

It is an object of the present invention to provide a so-called non-consumable electrode which does not react with oxygen produced in molten salt electrolysis of aluminum oxide and which has chemical resistance to the molten salt.

After extensive research and investigation to find out a novel non-consumable electrode for use in the molten salt electrolysis of aluminum oxide, the inventors have found that the oxides which have general formulas of X Y $O_2$ (where X is an monovalent metal, Y is a trivalent metal, and O is an oxygen atom), $D_2 E_2 O_7$ (where D is a trivalent metal, E is a tetravalent metal, and O is an oxygen atom), G R $O_4$ (where G is a trivalent or tetravalent metal, R is a pentavalent or tetravalent metal, and O is an oxygen atom, and R is selected from pentavalent metals where G is a trivalent metal while R is selected from tetravalent metal when G is a tetravalent metal), $$\left(\sum_{i=1}^{k} (Ai)\, X_{Ai}\right)\left(\sum_{j=1}^{l} (Bj)\, X_{Bj}\right)O_3$$

(where Ai and Bj are metal atoms, $X_{Ai}$, $X_{Bj}$ are molar fractions of Ai and Bj constituents, O is an oxygen atom, k and l are numbers of metal constituents constituting Ai and Bj, respectively, and constituent ions at positions A and B satisfy the requirements of $$\sum_{i=1}^{k} X_{Ai} = 1,\ \sum_{j=1}^{l} X_{Bj} = 1,\ O < X_{Ai} \leqq 1,\ O < X_{Bj} \leqq 1$$

(wherein if $X_{Ai} = 1$, then $O < X_{Bj} < 1$ and if $X_{Bj} = 1$ then $O < X_{Ai} < 1$), $\sum_{i=1}^{k} X_{Ai}\, n_{Ai} = \bar{n}_A$, $\sum_{j=1}^{l} X_{Bj}\, n_{Bj} = \bar{n}_B$, $\bar{n}_A + \bar{n}_B = 6$, $\sum_{i=1}^{k} r_{Ai} X_{Ai} = \bar{r}_A$, $\sum_{j=1}^{l} r_{Bj} X_{Bj} = \bar{r}_B$, $$0.8 < \frac{\bar{r}_A + r_o}{\sqrt{2}\,(\bar{r}_B + r_o)} < 1.1$$

(wherein $X_{Ai}$ and $X_{Bj}$ are molar fractions of the atoms, $n_{Ai}$ and $n_{Bj}$ are valences of the atoms, $r_{Ai}$ and $r_{Bj}$ are ion radii of the atoms and $r_o$ is ion radius of oxygen)), $L_a O_b.Ta_2 O_5$ (where L is a divalent, trivalent or tetravalent metal, O is an oxygen atom, and if A is a divalent metal, then b=y=1, if L is a trivalent metal, then a=2, b=3, and if A is a tetravalent metal then a=1, b=2), and $M_c O_d.Nb_2 O_5$ (where M is a divalent, trivalent or tetravalent metal, O is an oxygen atom, and if M is an divalent metal, then c=d=1, if A is a trivalent metal, then c=2, d=3 and if M is a tetravalent metal then c=1, d=2), exhibit high electronic conductivity at the temperature of about 900° to 1000° C., present catalytic action to the generation of oxygen and exhibit chemical resistance to the molten salt. In this way, a non-consumable electrode for aluminum reduction cells has been established.

Accordingly, the present invention provides a non-consumable electrode for use in the aluminum reduction cells at least that portion of the electrode which is brought into contact with a molten salt bath consists of a composition including at least 50% by weight of one or more oxides which have chemical resistance to the molten salt and electronic conductivity and general formulas of X Y $O_2$ (where X, Y and O are the same as those described above), $D_2 E_2 O_7$ (where D, E and O are the same as those described above), G R $O_4$ (where X, Y and O are the same as those described above), $$\left(\sum_{i=1}^{k} (Ai)\, X_{Ai}\right)\left(\sum_{j=1}^{l} (Bj)\, X_{Bj}\right)O_3$$

(where symbols and constituent ion conditions at positions A and B are the same as those described above), $L_a O_b.Ta_2 O_5$ (where symbols and conditions for L, a, b are the same as those described above) and $M_c O_d.Nb_2 O_5$ (where symbols and conditions for M, c, d are the same as those described above).

The electrode according to the present invention has at least that portion thereof which is brought into contact with the molten salt bath coated with or entirely formed by the composition which includes at least about 50% by weight of one or more oxides represented by the general formulas D, G $O_2$ (where X, Y, O are the same as those described above), $X_2 Y_2 O_7$ (where X, Y and O are the same as those described above), G R $O_4$ (where X, Y, O are the same as those described above), $$\left(\sum_{i=1}^{k} (Ai)\, X_{Ai}\right)\left(\sum_{j=1}^{l} (Bj)\, X_{Bj}\right)O_3$$

(where the symbols and constituent ion conditions at positions A and B are the same as those described above), $L_a O_b$. $Ta_2 O_5$ (where the symbols and the conditions for L, a, b are the same as those described above), and $M_c O_d.Nb_2 O_5$ (where the symbols and the conditions for M, a, d are the same as those described above).

Those oxides which are represented by the general formula $X Y O_2$ are usually called as delafossite structure oxides wherein X is a monovalent metal such as platinum, palladium, silver and copper, Y is a trivalent metal such as cobalt, yttrium, indium, chromium, nickel, rhodium, lead, iron and a lanthanide element. Those oxides which are represented by the general formula $D_2 E_2 O_7$ are called as pyrochlore structure oxides wherein D is a trivalent metal such as bismuth, yttrium, indium, thallium and a lanthanide element such as lanthanum, cerium, praseodymium, neodymium, samarium and the like, and E is a tetravalent metal such as tin, germanium, titanium, zirconium, platinum, ruthenium, iridium, rhodium, hafnium and osmium. Those oxides which are represented by the general formula $G R O_4$ are called as scheelite structure oxides wherein G is a trivalent metal such as bismuth, a lanthanide element and yttrium or a tetravalent metal such as zirconium, hafnium, tin and thorium, and R is a pentavalent metal such as niobium, tantalum, antimony and vanadium or a tetravalent metal such as germanium and tin (if G is a trivalent metal R is selected from pentavalent metals while if G is a tetravalent metal R is selected from tetravalent metals). Those oxides which are represented by the general formula $$\left\{\sum_{i=1}^{k} (Ai)\, X_{Ai}\right\}\left\{\sum_{j=1}^{l} (Bj)\, X_{Bj}\right\}O_3$$

are called as composite perovskite structure oxides wherein Ai is a metal such as a lanthanide element, an actinide element, yttrium, thallium, silver, bismuth, lead, barium, zirconium, cadmium nd hafnium, and Bj is an element such as a lanthanide element, an actinide element, aluminum, gallium, indium, lithium, potassium, silicon, germanium, tin, scandium, titanium, vanadium, chromium, manganese, iron, cobalt, nickel, copper, zinc, yttrium, zirconium, niobium, silver molybdenum, ruthenium, rhodium, palladium, antimony, tellurium, hafnium, tantalum, tungsten, rhenium, iridium, thallium, thorium and platinum. Those oxides which are represented by the general formula $L_a O_b.Ta_2 O_5$ are called as rutile structure oxides and those represented by $M_c O_d.Nb_2 O_5$ are called as columbite structure oxides, wherein L and M are a divalent metal such cobalt, nickel, zinc, copper, magnesium, calcium, manganese, tin, iron and lead, and preferably cobalt, nickel, zinc, tin and iron, or a trivalent metal such as iron, chromium, aluminum, indium, manganese, cobalt, nickel and rhodium, and preferably iron, chromium, aluminum, indium, or a tetravalent metal such as tin, titanium, germanium, silicon, zirconium and hafnium, and preferably tin, titanium and zirconium.

More particularly, the oxide represented by the general formula $XYO_2$ includes $PtCoO_2$, $PtRhO_2$, $PdCoO_2$, $PdRhO_2$, $PdNiO_2$, $AgInO_2$, $AgCoO_2$, $AgRhO_2$; the oxide represented by the general formula $D_2E_2O_7$ includes $Bi_2Rh_2O_7$, $Bi_2Ir_2O_7$, $Bi_2Ru_2O_7$, $Bi_2Sn_2O_7$, $La_2Ti_2O_7$, $La_2Ir_2O_7$, $La_2Sn_2O_7$, $La_2Zr_2O_7$, $La_2Ge_2O_7$, $La_2Ru_2O_7$, $La_2Os_2O_7$, $Y_2Ti_2O_7$, $Y_2Hf_2O_7$, $Y_2Sn_2O_7$, $Y_2Zr_2O_7$, $Y_2Ge_2O_7$, $Y_2Ru_2O_7$, $Y_2Os_2O_7$, $Y_2Ir_2O_7$, $Ce_2Ti_2O_7$, $Ce_2Sn_2O_7$, $Ce_2Zr_2O_7$, $Ce_2Ge_2O_7$, $Ce_2Ru_2O_7$, $Ce_2Os_2O_7$, $Ce_2Hf_2O_7$, $Ce_2Ir_2O_7$, $In_2Ge_2O_7$, $In_2Sn_2O_7$, $La_2Pt_2O_7$, $Y_2Pt_2O_7$, $Pr_2Zr_2O_7$, $Pr_2Sn_2O_7$, $Nd_2Zr_2O_7$, $Nd_2Sn_2O_7$, $Sm_2Zr_2O_7$, $Sm_2Sn_2O_7$ (while pure oxides such as $La_2Sn_2O_7$ and $Y_2Zr_2O_7$ usually have low electronic conductivity and it may be difficult to use them as an electronic conductive material, they can be rendered highly conductive by having certain constituent added thereto. For example, by adding 5 mole % of ZnO and 5 mol % of CuO to $La_2Sn_2O_7$, it is possible to improve the conductivity by the factor of at least 1000 times. Since it is common practice to represent such a conductivity-imparted oxide by $La_2Sn_2O_7$, they are represented herein in accordance with the common practice.); the oxide represented by the general formula $GRO_4$ includes $ZrGeO_4$, $ThGeO_4$, $ArSnO_4$, $LaTaO_4$, $LaNbO_4$, $YTaO_4$, $YNbO_4$; the oxide represented by the general formula $$\left\{\sum_{i=1}^{k} (Ai)\, X_{Ai}\right\}\left\{\sum_{j=1}^{l} (Bj)\, X_{Bj}\right\}O_3$$

includes

1. $A(B_1)_{\frac{2}{3}}(B_2)_{\frac{1}{3}}O_3$ $$\begin{cases} A = \text{La, Y, Bi} \\ B_1 = \text{Ni, Co, Cu, Zn, Pd} \\ B_2 = \text{Ta, Nb} \end{cases}$$

2. $A(B_1)_{\frac{3}{4}}(B_2)_{\frac{1}{4}}O_3$ $$\begin{cases} A = \text{La, Y, Bi} \\ B_1 = \text{Ni, Co, Cu, Zn, Pd} \\ B_2 = \text{W, Re} \end{cases}$$

3. $A(B_1)_{\frac{1}{2}}(B_2)_{\frac{1}{2}}O_3$ $$\begin{cases} A = \text{La, Y, Bi} \\ B_1 = \text{Ni, Co, Cu, Zn, Pd} \\ B_2 = \text{Zr, Hf, Ti, Sn, Ge, Th, Pt, Ir, Ru} \end{cases}$$

4. $A(B_1)_{\frac{1}{2}}(B_2)_{\frac{1}{2}}O_3$ $$\begin{cases} A = \text{La, Y, Bi} \\ B_1 = \text{In, Al, Fe, Cr, Mn, Y, Rh} \\ B_2 = \text{In, Al, Fe, Cr, Mn, Y, Rh} \end{cases}$$

provided that when $A$ is yttrium, $B_1$ and $B_2$ are not yttrium.

5. $A(B_1)_{\frac{1}{2}}(B_2)_{\frac{1}{2}}O_3$ $$\begin{cases} A = \text{La, Y, Bi} \\ B_1 = \text{Ag, Tl, Li, K} \\ B_2 = \text{Ta, Nb} \end{cases}$$

6. $A(B_1)_{\frac{2}{5}}(B_2)_{\frac{3}{5}}O_3$ $$\begin{cases} A = \text{Pb, Ba, Cd} \\ B_1 = \text{Ag, Tl} \\ B_2 = \text{W, Re} \end{cases}$$

7. $A(B_1)_{\frac{1}{4}}(B_2)_{\frac{3}{4}}O_3$ $$\begin{cases} A = \text{Pb, Ba, Cd} \\ B_1 = \text{Ag, Tl} \\ B_2 = \text{Ta, Nb} \end{cases}$$

8. $A(B_1)_{\frac{1}{2}}(B_2)_{\frac{1}{2}}O_3$ $$\begin{cases} A = \text{Pb, Ba, Cd} \\ B_1 = \text{Ni, Co, Cu, Zn, Pd} \\ B_2 = \text{W, Re} \end{cases}$$

-continued

9. $A(B_1)_{\frac{1}{3}}(B_2)_{\frac{2}{3}}O_3$ $$\begin{cases} A = \text{Pb, Ba, Cd} \\ B_1 = \text{Ni, Co, Cu, Zn, Pd} \\ B_2 = \text{Ta, Nb} \end{cases}$$

10. $A(B_1)_{\frac{2}{3}}(B_2)_{\frac{1}{3}}O_3$ $$\begin{cases} A = \text{Pb, Ba, Cd} \\ B_1 = \text{La, In, Al, Fe, Cr, Mn, Y, Rh} \\ B_2 = \text{W, Re} \end{cases}$$

11. $A(B_1)_{\frac{1}{2}}(B_2)_{\frac{1}{2}}O_3$ $$\begin{cases} A = \text{Pb, Ba, Cd} \\ B_1 = \text{La, In, Al, Fe, Cr, Mn, Y} \\ B_2 = \text{Ta, Nb} \end{cases}$$

12. $A(B_1)_{\frac{1}{4}}(B_2)_{\frac{3}{4}}O_3$ $$\begin{cases} A = \text{Ag, Tl} \\ B_1 = \text{Ni, Co, Cu, Zn, Pd} \\ B_2 = \text{W, Re} \end{cases}$$

13. $A(B_1)_{\frac{1}{3}}(B_2)_{\frac{2}{3}}O_3$ $$\begin{cases} A = \text{Ag, Tl} \\ B_1 = \text{La, In, Al, Fe, Cr, Mn, Y, Rh} \\ B_2 = \text{W, Re} \end{cases}$$

14. $A(B_1)_{\frac{1}{2}}(B_2)_{\frac{1}{2}}O_3$ $$\begin{cases} A = \text{Ag, Tl} \\ B_1 = \text{Zr, Hf, Ti, Sn, Ge, Th, Pt, Ir, Ru} \\ B_2 = \text{W, Re} \end{cases}$$

15. $(A_1)_{\frac{1}{2}}(A_2)_{\frac{1}{2}}BO_3$ $$\begin{cases} A_1 = \text{Ag, Tl} \\ A_2 = \text{Bi, La, Y} \\ B = \text{Zr, Hf, Ti, Sn, Ge, Th, Pt, Ir, Ru} \end{cases}$$

16. $(A_1)_{\frac{1}{2}}(A_2)_{\frac{1}{2}}(B_1)_{\frac{1}{2}}(B_2)_{\frac{1}{2}}O_3$ $$\begin{cases} A_1 = \text{Ag, Tl} \\ A_2 = \text{La, Y, Bi} \\ B_1 = \text{In, Al, Fe, Cr, Mn} \\ B_2 = \text{Ta, Nb} \end{cases}$$

Preferably, a perovskite structure composite oxide such as $La(Ni_{\frac{2}{3}}Ta_{\frac{1}{3}})O_3$, $La(Ni_{\frac{2}{3}}Nb_{\frac{1}{3}})O_3$, $La(Pd_{\frac{2}{3}}Ta_{\frac{1}{3}})O_3$, $La(Pd_{\frac{2}{3}}Nb_{\frac{1}{3}})O_3$, $Y(Ni_{\frac{2}{3}}Ta_{\frac{1}{3}})O_3$, $Y(Ni_{\frac{2}{3}}Nb_{\frac{1}{3}})O_3$, $Y(Pd_{\frac{2}{3}}Ta_{\frac{1}{3}})O_3$, $Y(Pd_{\frac{2}{3}}Nb_{\frac{1}{3}})O_3$, $Bi(Ni_{\frac{2}{3}}Ta_{\frac{1}{3}})O_3$, $Bi(Ni_{\frac{1}{2}}Zr_{\frac{1}{2}})O_3$, $La(Ni_{\frac{1}{2}}Pt_{\frac{1}{2}})O_3$, $Y(Ni_{\frac{1}{2}}Pt_{\frac{1}{2}})O_3$, $La(In_{\frac{1}{2}}Y_{\frac{1}{2}})O_3$, $La(In_{\frac{1}{2}}Al_{\frac{1}{2}})O_3$, $La(Pd_{\frac{1}{2}}Sn_{\frac{1}{2}})O_3$, $Y(Pd_{\frac{1}{2}}Sn_{\frac{1}{2}})O_3$, $Bi(Pd_{\frac{1}{2}}Sn_{\frac{1}{2}})O_3$, $(Ag_{\frac{1}{2}}Bi_{\frac{1}{2}})ZrO_3$, $(Ag_{\frac{1}{2}}Y_{\frac{1}{2}})SnO_3$, $(Ag_{\frac{1}{2}}La_{\frac{1}{2}})(In_{\frac{1}{2}}Ta_{\frac{1}{2}})O_3$, $(Ag_{\frac{1}{2}}Bi_{\frac{1}{2}})(In_{\frac{1}{2}}Nb_{\frac{1}{2}})O_3$, $La(Y_{\frac{1}{2}}Fe_{\frac{1}{2}})O_3$, $La(Y_{\frac{1}{2}}Mn_{\frac{1}{2}})O_3$, $La(Fe_{\frac{1}{2}}In_{\frac{1}{2}})O_3$, $La(Fe_{\frac{1}{2}}Mn_{\frac{1}{2}})O_3$ may be selected. The oxides represented by the general formulas $L_aO_b\ Ta_2O_5$ and $M_cO_d.Nb_2O_5$ include $CoO.Ta_2O_5$, $CoO.Nb_2O_5$, $NiO.Ta_2O_5$, $NiO.Nb_2O_5$, $ZnO.Ta_2O_5$, $ZnO.Nb_2O_5$, $SnO.Ta_2O_5$, $SnO.Nb_2O_5$, $FeO.Ta_2O_5$, $FeO.Nb_2O_5$, $Fe_2O_3.Ta_2O_3$, $Fe_2O_3.Nb_2O_5$, $Cr_2O_3.Ta_2O_5$, $Cr_2O_3.Nb_2O_5$, $Al_2O_3.Ta_2O_5$, $Al_2O_3.Nb_2O_5$, $In_2O_3.Ta_2O_5$, $In_2O_3.Nb_2O_5$, $SnO_2.Ta_2O_5$, $SnO_2.Nb_2O_5$, $TiO_2.Ta_2O_5$, $TiO_2.Nb_2O_5$, $ZrO_2.Ta_2O_5$, $ZrO_2.NB_2O_5$. (While pure composite oxide such as $Al_2O_3.Ta_2O_5$ usually has a low electronic conductivity and it is difficult to use it as an electronic conductive material, it may be rendered highly conductive by having certain constituent added thereto. Since it is a common practice to represent such a conductivity-imparted oxide by $Al_2O_3.Ta_2O_5$, it is represented herein in accordance with the common practice.)

The oxides of the present invention as represented by the general formulas $XYO_2$, $D_2E_2O_7$, $BRO_4$, $$\left\{\sum_{i=1}^{k}(Ai)X_{Ai}\right\}\left\{\sum_{j=1}^{l}(Bj)X_{Bj}\right\}O_3,$$

$A_xO_y.Ta_2O_5$ and $M_cO_d.Nb_2O_5$ are electronic conductive and are different from the known ion-conductive electrode in their electro-conductive modes and also different from a tin oxide electrode in their crystal structures and hence they provide an electrode of a novel composition. The electrode made of such electronic conductive oxide ceramics exhibits excellent effect of high conductivity under electrolysis conduction and high resistance to a molten salt bath containing cryolite as main component.

The electrode of the present invention is prepared by forming at least that portion thereof which is brought into contact with the molten salt by composition including at least 50% by weight, preferably at least 75% by weight of an oxide selected from these represented by $XYO_2$, $D_2E_2O_7$, $GRO_4$, $$\left\{\sum_{i=1}^{k}(Ai)X_{Ai}\right\}\left\{\sum_{j=1}^{l}(Bj)X_{Bj}\right\}O_3,$$

$L_aO_b.Ta_2O_5$, $M_cO_d.Nb_2O_5$ or mixture thereof.

In the manufacture of the electrode of the present invention, in order to enhance the density of the electrode, heat resistance, thermal-shock resistance, resistance to molten bath, and electric conductivity, spinel structure oxide or perovskite structure may be mixed to the electronic conductive oxide ceramics, as required. The content of the additive is usually not more than 50% by weight, and oxides, carbides, nitrides, borides and silicides of alkali metals, alkaline earth metals, transition metals, platinum group metals and rare earth elements may be mixed therein as required. The amount of such additives is usually not more than 50% by weight because the electric conductivity, resistance to bath and resistance to oxidation are deteriorated above 50% by weight. The particularly preferred additives are oxides of transition metals such as manganese oxide, nickel oxide, cobalt oxide and iron oxide, or oxides of platinum group metals such as ruthenium oxide, palladium oxide, platinum oxide, rhodium oxide and iridium oxide, or oxides of rare earth elements such as yttrium oxide, cerium oxide, neodymium oxide and lanthanum oxide, or titanium nitride, titanium boride, lanthanum boride, zirconium boride and tungsten silicide.

An optimum condition for the electrical resistance of the electronic conductive oxide ceramics used for the electrode depends on the shape of the electrode, that is, the thickness of the coating, and the material thereof preferably has the conductivity of at least about 0.1 $\Omega^{-1}\ cm^{-1}$ (at 1000° C.).

The electronic conductive oxide ceramics for coating or forming the electrode of the present invention has a melting point higher than the operating temperature of an electrolytic cell, usually at or higher than about 1000° C. and preferably at or higher than 1200° C.

The electrode of the present invention may be prepared by forming a coating including the above oxide ceramics on a surface of an electrode base of a conductive material such as a metal or alloy e.g. titanium, nickel or copper, carbon, graphite or such as a carbide, nitride, boride or silicide of titanium, molybdenum or tungsten, or the electrode may be entirely made of the composition including the above oxide ceramics.

In coating the surface of the electrode with the oxide ceramics, the composition including the composition as represented by the general formula $XYO_2$, $D_2E_2O_7$, $GRO_4$, $$\left\{\sum_{i=1}^{k}(Ai)X_{Ai}\right\}\left\{\sum_{j=1}^{l}(Bj)X_{Bj}\right\}O_3,$$

$L_aO_b.Ta_2O_5$ or $M_cO_d.Nb_2C_5$ may be flame sprayed or plasma sprayed and then heat treated as required, or it may be electroplated. Alternatively, inorganic or organic metal compounds which may form the oxide of the above structure when it is sintered may be applied, dipped, sprayed or deposited by thermal decomposition, followed by sintering, or an electrode base made of an alloy which forms the oxide of the above structure when it is oxidized or an electrode base coated with such an alloy is prepared and then it is oxidized. It should be understood that in coating the electrode base with the oxide ceramics, an internal layer of an oxide of platinum group metal may be provided therebetween to enhance the adhesiveness of the oxide ceramics to the base.

In practicing the present invention, the oxide as represented by the general formula $XYO_2$, $D_2E_2O_7$, $GRO_4$, $$\left\{\sum_{i=1}^{k}(Ai)X_{Ai}\right\}\left\{\sum_{j=1}^{l}(Bj)X_{Bj}\right\}O_3,$$

$L_aO_b.Ta_2O_5$ or $M_cO_d.Nb_2O_5$ may be preferably prepared by sintering a mixture of appropriate composition such as oxide, hydroxide, chloride, sulfate, nitrate, carbonate or oxalate of said metal, usually at 500° C. or higher and preferably at 800°-2500° C. The sintering may be conducted in a high frequency induction heating furnace or a resistance heating furnace at 500° C. or higher and preferably at 800°-2500° C. under reduced pressure, atmospheric pressure or elevated pressure and preferably by hot pressing under 50-1000 kg/cm$^2$.

When the electrode of the present invention is to be applied to an aluminum reduction cell, the connection between the electrode and a conductor stud need not be specified but conventional means may be used. That is, the connection by threading, welding, molding or casting may be used or the connection may be made through a low melting point metal such as aluminum, tin or copper, or alloy or metallic compound thereof.

For uniformity of voltage and reduction in corrosion of the surface, it is useful to coat the surface of the non-consumable anode of the present invention, except that portion thereof required to make the electric current to flow, with an anti-corrosive insulating material such as $ZrO_2$, $ZnAl_2O_4$, $MgAl_2O_4$, $LaAlO_3$ or $La_2Zr_2O_7$.

The most general use of the non-consumable electrode of the present invention thus obtained is to replace conventional carbon electrode at least in its portion in contact with the molten salt bath in the electrolysis of aluminum oxide dissolved in a molten cryolite bath into aluminum.

Referring to the accompanying drawing, an application in which the electrode of the present invention is used as an anode for manufacturing aluminum is explained.

FIG. 1 shows an example of the anode of the present invention. In FIG. 1, a conductive bar 1 is embedded in an anode base 2 made of a conductive material having a melting point higher than electrolysis temperature, such as a metal, an alloy, carbon or graphite. On a surface of the anode base 2 a coating 3 of the electronic conductive oxide ceramics in accordance with the present invention is formed by an appropriate method to complete the anode.

Figure 2:
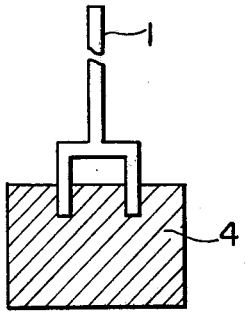

In FIG. 2, an anode 4 is entirely made of the electronic conductive oxide ceramics of the present invention, in which the conductive bar 1 is embedded to complete the anode.

Figure 3:
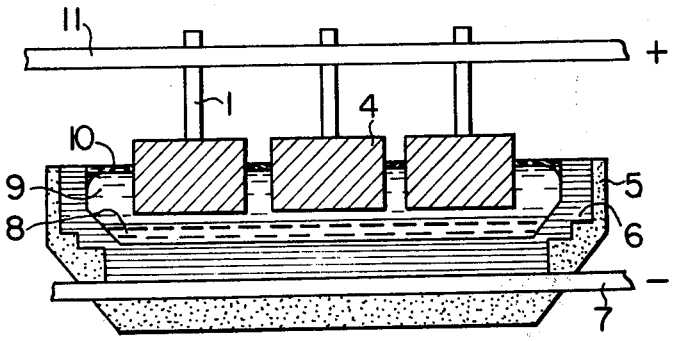

FIG. 3 shows a schematic diagram for conducting actual electrolysis while disposing the anode of the present invention in a reduction cell. The reduction cell comprises an outer shell made of steel, a lining 5 of appropriate insulating material, and a lining 6 of carbonacious material, carbide, boride or the ceramics of the present invention. The molten aluminum precipitates at the bottom of molten electrolyte 9 and top surface of the molten electrolyte 9 is covered with a crust 10. The anode 4 of the present invention suspended from the conductive bar 1 is positioned in the molten electrolyte 9 to be appropriately spaced from the surface of the precipitated aluminum. The conductive bar 1 is movably connected to a bus bar 11.

With the electrolytic cell thus constructed, aluminum is separated as electric current is passed.

While the application to the anode has been illustrated, it should be understood that the electrode of the present invention may also used as a cathode for the aluminum reduction cell.

The anode according to the present invention has the following advantages over the prior art carbon anode; (1) since the novel electrode of the present invention is not consumed unlike the prior art carbon anode, the replacement period may be set to more than several months, usually one-half to one year, thus the number of times for the replacement of the electrodes is considerably reduced, (2) since it is not oxidation-consumed unlike the carbon anode, the frequency of adjusting the distance between the anode and the precipitated aluminum can be materially reduced thereby the electrolysis operation is simplified, manufacturing cost is reduced and the possibility of misoperation of the operator is minimized.

EXAMPLE 1

Powder of oxide mixture consisting of 55.4 parts by weight of palladium oxide, 5.0 parts by weight of platinum oxide and 39.6 parts by weight of cobalt oxide was dry-blended in a ball mill for 15 hours and then formed by a rubber press under pressure (1000 kg/cm$^2$), and sintered in a silicon carbide resistor electric furnace at 900° C. for 24 hours to prepare an electrode mainly consisting of delafossite structure oxide of $PdCoO_2$, $PtCoO_2$. The sintered anode was hard and solid and showed the conductivity of 100 $\Omega^{-1}$ cm$^{-1}$ at 1000° C. Then, the anode was drilled and copper was cast therein and a platinum lead wire was connected thereto to complete an electrolysis anode.

The anode prepared in the above manner was used with a cryolite bath maintained at 950° C. and containing saturated aluminum oxide, and the electrolysis was continuously conducted for 3 months at a current density of 1 A/cm$^2$ and voltage of 4.0 volts while sequentially adding aluminum oxide. The decomposition voltage was 2.2 volts, which was close to a theoretical value and the overvoltage was low. The current efficiency was 95% and it was observed that there occurred no corrosion of the anode during the electrolysis.

EXAMPLE 2

A titanium substrate, which had been fully cleaned, was palladium plated by alkaline aqueous solution including palladium chloride while passing current of 0.2 A/cm$^2$ for 10 minutes. It was then dipped in aqueous solution of cobalt chloride and cobalt plated at current density of 0.1 A/cm$^2$ until the weight ratio of palladium to cobalt of 1.81 was attained. The titanium piece having two plated layers thereon was oxidation-treated in a silicon carbide resistor electric furnace at 900° C. for 100 hours. To the resulting titanium piece having delafossite structure oxide coating of $PdCoO_2$, a platinum lead wire was attached to complete an anode for the electrolysis.

The anode prepared in the above manner was used under the same conditions as in Example 1 to conduct continuous electrolysis of aluminum oxide for 3 months. The decomposition voltage was 2.2 V, the current efficiency was 95% and there was no corrosion and strip-off of the anode during the electrolysis.

EXAMPLE 3

Powder of oxide mixture consisting of 48.9 parts by weight of lanthanum oxide, 45.1 parts by weight of tin oxide, 2.0 parts by weight of zinc oxide, 2.0 parts by weight of niobium oxide and 2.0 parts by weight of copper oxide was dry blended in a ball mill for 15 hours and then formed by a rubber press under pressure (1000 kg/cm$^2$) and sintered in a silicon carbide resistor electric furnace at 1200° C. for 24 hours to prepare an electrode mainly consisting of pyrochlore structure oxide of $La_2Sn_2O_7$. The sintered anode was hard and solid and showed the conductivity of 1 $\Omega^{-1}$ cm$^{-1}$ at 1000° C. Then the anode was drilled and copper was casted thereinto, and a platinum lead wire was connected to complete an anode for the electrolysis.

The anode thus constructed was used under the same conditions as in Example 1 to conduct continuous electrolysis of aluminum oxide for 3 months. The decomposition voltage was 2.2 V, the current efficiency was 95% and there was no corrosion of the anode during the electrolysis.

EXAMPLE 4

Powder of oxide mixture consisting of 44.4 parts by weight of zirconium oxide, 3.7 parts by weight of germanium oxide, 48.9 parts by weight of tin oxide, 2.0 parts by weight of copper oxide and 1.0 parts by weight of indium oxide was dry blended in a ball mill for 15 hours and then formed by a rubber press under pressure (200 kg/cm$^2$) and sintered in a silicon carbide resistor electric furnace at 1200° C. for 24 hours. The resulting sintered material of scheelite structure oxide mainly consisting of $ZrGeO_4$, $ZrSnO_4$ was milled by a vibrating mill into particles of less than 5$\mu$. In a separate step, a titanium substrate, which had been fully cleaned, was platinum plated by aqueous solution of chloroplatinic acid while passing current of 0.05 A/cm$^2$ for 30 minutes. To the platinum plated titanium substrate, the milled scheelite structure oxide powder was applied by a plasma spray unit to complete an anode for the electrolysis.

The anode thus constructed was used under the same conditions as in Example 1 to conduct continuous electrolysis of aluminum oxide for 3 months. The decomposition voltage was 2.2 V, the current efficiency was 92%, and there was no appreciable corrosion and strip-off of the anode after the electrolysis.

EXAMPLE 5

Powder of oxide mixture consisting of 48.9 parts by weight of lanthanum oxide, 45.1 parts by weight of tin oxide, 2.0 parts by weight of zinc oxide, 2.0 parts by weight of niobium oxide and 2.0 parts by weight of copper oxide was dry blended in a ball mill for 15 hours, and then formed by an oil pressure press under pressure (200 kg/cm$^2$) and presintered in a silicon carbide resistor electric furnace at 1000° C. for 24 hours to produce a sintered material, which was then milled into particles of less than 5$\mu$ six and formed into a shape shown by 6 in FIG. 3 is a rubber press under pressure (1000 kg/cm$^2$). Then it was sintered in the silicon carbide resistor electric furnace at 1200° C. for 40 hours to prepare a cathode mainly consisting of pyrochlore structure oxide of $La_2Sn_2O_7$.

The sintered body was then drilled and copper was casted therein, which was then connected to a titanium rod to complete an cathode for the electrolysis.

The cathode thus constructed and a carbon anode were used with a cryolite bath maintained at 950° C. and containing saturated aluminum oxide to conduct the electrolysis of aluminum oxide continuously for one month at a current density of 1 A/cm$^2$, voltage of 4.5 V while sequentially adding aluminum oxide and replacing the graphite anode at a fixed interval. The corrosion of the cathode by the electrolyte bath and the molten aluminum was not observed.

EXAMPLE 6

Powder of oxide mixture consisting of 53.6 parts by weight of lanthanum oxide, 18.6 parts by weight of yttrium oxide, 22.8 parts by weight of indium oxide and 5.0 parts by weight of tantalum oxide was dry blended in a ball mill for 15 hours and then formed by a rubber press under pressure (1000 kg/cm$^2$) and sintered in a silicon carbide resistor electric furnace at 1400° C. for 24 hours to prepare an electrode mainly consisting of composite perovskite structure oxide of $LaY_{\frac{1}{2}}In_{\frac{1}{2}}O_3$.

The sintered anode was hard and solid, and showed the conductivity of 1 $\Omega^{-1}$ cm$^{-1}$ at 1000° C. The anode was then drilled and copper was casted therein and a platinum lead wire was connected thereto to complete an anode for the electrolysis.

The anode thus constructed was used with a cryolite bath maintained at 950° C. and containing saturated aluminum oxide to conduct the electrolysis of the aluminum oxide at a current density of 1 A/cm$^2$ and voltage of 4.0 V continuously for 3 months while sequentially adding aluminum oxide. The decomposition voltage was 2.2 V which was close to a theoretical value and the overvoltage was low. The current efficiency was 95%, and there was no corrosion of the anode during the electrolysis.

EXAMPLE 7

Mixture consisting of 55.7 parts by weight of lanthanum oxide, 17.1 parts by weight of nickel oxide, 25.2 parts by weight of tantalum pentoxide and 2.0 parts by weight of niobium pentoxide and a small amount of water were wet blended in a ball mill for 24 hours and sintered in a silicon carbide resistor electric furnace at 1300° C. for 24 hours. The sintered material was milled into particles of less than 400 Taylor mesh size. The particles were then applied onto a nickel metal substrate by a plasma spray unit. In this manner an anode having a coating mainly consisting of composite perovskite structure oxide of $La(Ni_{\frac{2}{3}}Ta_{\frac{1}{3}})O_3$ on a nickel substrate was manufactured. The anode thus constructed was used with a cryolite bath maintained at 950° C. and containing saturated aluminum oxide to conduct the electrolysis of aluminum oxide at a current density of 1 A/cm$^2$ and voltage of 5.0 V continuously for one month while sequentially adding aluminum oxide. The decomposition voltage approximately corresponded to a theoretical value. The current efficiency was 95% and there was no appreciable corrosion and strip-off of the anode coating after the electrolysis.

EXAMPLE 8

A titanium substrate which had been fully cleaned was platinum plated using aqueous bath of chloroplatinic acid to prepare an anode base having platinum coating layer.

On the surface of the above anode base, powder of composite perovskite structure of $La(Y_{\frac{1}{2}}In_{\frac{1}{2}})O_3$ manufactured in the same manner as Example 1 was applied using a plasma spray device. The titanium anode having the composite perovskite coating and the platinum internal layer was then used to continuously conduct the electrolysis of aluminum oxide for one month. The decomposition voltage was 2.2 V and the current efficiency was 95% and there was no corrosion and strip-off of the anode during the electrolysis.

EXAMPLE 9

Powder of oxide mixture consisting of 65.4 parts by weight of tantalum pentoxide, 23.6 parts by weight of ferric oxide, 10.0 parts by weight of stannic oxide and 1.0 parts by weight of antimony trioxide were dry blended in a ball mill for 15 hours, and then formed by a rubber press under pressure (1000 kg/cm$^2$) and sintered in a high frequency induction heating furnace at 1450° C. for 5 hours to prepare an electrode mainly consisting of composite oxide having a structure of $Fe_2O_3.Ta_2O_5$. The sintered anode was hard and solid and showed the conductivity of 1.0 $\Omega^{-1}$ cm$^{-1}$ at 1000° C. The anode was then drilled and copper was cast therein and a platinum lead wire was connected thereto to complete an anode for the electrolysis.

The anode thus constructed was used with a cryolite bath maintained at 950° C. and containing aluminum oxide to conduct continuous electrolysis for three months at a current density of 1 A/cm$^2$ and voltage of 5.0 V while sequentially adding aluminum oxide. The decomposition voltage was 2.2 V which approximately corresponded to a theoretical value and the overvoltage was low. The current efficiency was 90% and there was no corrosion of the anode during the electrolysis.

EXAMPLE 10

Powder of oxide mixture consisting of 70.8 parts by weight of tantalum pentoxide, 25.3 parts by weight of stannic oxide, 1.3 parts by weight of zinc oxide and 2.6 parts by weight of ferric oxide was wet blended in a ball mill for 15 hours and then sintered in a silicon carbide resistor electric furnace at 1500° C. for 20 hours. The sintered product was milled into particles of less than 200 Taylor mesh size. The powder was then applied onto a nickel substrate by a plasma spray device to prepare an anode having a coating mainly consisting of composite oxide having the structure of $SnO_2.Ta_2O_5$.

The anode thus constructed was used with a cryolite bath maintained at 950° C. and containing saturated aluminum oxide to conduct continuous electrolysis of aluminum oxide for three months at a current density of 0.9 A/cm$^2$ and voltage of 5.0 V while sequentially adding aluminum oxide. The decomposition voltage was approximately equal to a theoretical value and the overvoltage was low. There was no appreciable corrosion and strip-off of the anode coating.

EXAMPLE 11

Powder of oxide mixture consisting of 35.1 parts by weight of niobium pentoxide, 45.9 parts by weight of tantalum pentoxide, 16.4 parts by weight of nickel monoxide and 2.6 parts by weight of ferric oxide was used in the same manner as Example 1 to prepare sintered anodes mainly consisting of composite oxide having the structure of $NiO.Ta_2O_5$ and $NiO.Nb_2O_5$.

Powder of oxide mixture consisting of 72.5 parts by weight of lanthanum oxide, and 27.5 parts by weight of zirconium oxide was milled in a ball mill for 10 hours and then sintered at 1500° C. for five hours and then milled into particles of less than 200 Taylor mesh size. The pyrochlore structure composite oxide of $La_2Zr_2O_7$ thus prepared was plasma sprayed on the above sintered anode except the bottom surface thereof. In this manner, the anode made of $NiO.Ta_2O_5$ and $NiO.Nb_2O_5$ having the coating of low conductivity $La_2Zr_2O_7$ on the sides thereof was prepared. The similar electrolysis to that of Example 1 was conducted using the above anodes. There was no appreciable corrosion and resolution of the anode base and the anode side and the decomposition voltage was approximately equal to the theoretical value and the overvoltage was low, and hence the excellent property of non-consumable anode was proved.

EXAMPLE 12

Powder of oxide mixture consisting of 39.2 parts by weight of lanthanum oxide, 14.8 parts by weight of zirconium oxide, 10.6 parts by weight of ferric oxide, 29.4 parts by weight of tantalum pentoxide, 5.0 parts by weight of tin oxide and 1.0 part by weight of antimony oxide was used in the same manner as Example 1 to prepare a sintered anode mainly consisting of composite oxide having the structures of $La_2O_3.ZrO_2$ and $Fe_2O_3.Ta_2O_5$. The anode thus constructed was used with a cryolite bath maintained at 950° C. and containing saturated aluminum oxide to conduct continuous electrolysis for three months at a current density of 0.9 A/cm$^2$ and a voltage of 5.0 V while sequentially adding aluminum oxide. The decomposition voltage was approximately equal to a theoretical value and the overvoltage was low. There was no appreciable corrosion and strip-off of the anode coating.

EXAMPLE 13

Powder of the composite oxide having the structure of $Fe_2O_3.Ta_2O_5$ prepared in Example 9 was formed into a shape as shown by 6 in FIG. 3 by a rubber press under pressure (1000 kg/cm$^2$). Then it was sintered in a high frequency induction heating furnace at 1500° C. for 24 hours to prepare a cathode mainly consisting of composite oxide having the structure of $Fe_2O_3.Ta_2O_5$. The sintered electrode was then drilled and copper was cast therein and a nickel rod was connected thereto to complete an cathode for the electrolysis.

The cathode thus constructed was used with a cryolite bath maintained at 950° C. and containing saturated aluminum oxide and a carbon anode to conduct the electrolysis continuously for one month at a current density of 1 A/cm$^2$ and a voltage of 4.6 V while sequentially adding aluminum oxide and replacing the graphite anode at a fixed time interval. The corrosion of the cathode by the molten aluminum after the electrolysis was observed to be slight.

What is claimed is:

1. A method for producing aluminum by the molten salt electrolysis of aluminum oxide which comprises electrolyzing aluminum oxide dissolved in a molten salt containing aluminum sodium fluoride as the main component at a temperature of about 900° C. to about 1000° C. by passing a direct current therefor through an anode to a cathode disposed in said molten salt, wherein at least a portion of said anode that is brought into contact with said molten salt is made of or covered with a composition which includes at least about 50% by weight of electronic conductive oxide ceramics selected from one or a combination of oxides represented by general formulae $XYO_2$ wherein X is a monovalent metal, Y is a trivalent metal and O is an oxygen atom; $D_2E_2O_7$ wherein D is a trivalent metal, E is a tetravalent metal and O is an oxygen atom; and $GRO_4$ wherein G is a trivalent or tetravalent metal, R is a pentavalent or tetravalent metal and O is oxygen atom, with the proviso that when G is a trivalent metal then R is selected from pentavalent metals, and when G is a tetravalent metal then R is selected from tetravalent metals.

2. The method of claim 1 wherein at least that portion of the electrode base which is brought into contact with the molten salt bath is coated with the composition including at least about 50% by weight of electronic conductive oxide ceramics.

3. The method of claim 1, wherein at least that portion of the electrode which is brought into contact with the molten salt bath is entirely made of the composition including at least about 50% by weight of electronic conductive oxide ceramics.

4. The method of claim 1, wherein oxide, nitride, boride or silicide of an element selected from transition metal, platinum group metal and rare earth element is added to the electronic conductive oxide ceramics as an additive.

5. The method of claim 1, wherein conductivity of the electronic conductive oxide ceramics is at least 0.1 $\Omega^{-1}$ cm$^{-1}$ at 1000° C.

6. The method of claim 1, wherein melting point of the electronic conductive oxide ceramics is at or above 1200° C.

7. The method of claim 1, wherein the electronic conductive oxide ceramics is a delafossite structure oxide selected from the group consisting of $PtCoO_2$, $PtRhO_2$, $PdCoO_2$, $PdRhO_2$, $PdNiO_2$, $AgInO_2$, $AgCoO_2$ and $AgRhO_2$.

8. The method of claim 1, wherein the electronic conductive oxides ceramics is a pyrochlore structure oxide selected from the group consisting of $La_2Ti_2O_7$, $La_2Ir_2O_7$, $La_2Sn_2O_7$, $La_2Zr_2O_7$, $La_2Ge_2O_7$, $La_2Ru_2O_7$, $La_2Os_2O_7$, $Y_2Ti_2O_7$, $Y_2Hf_2O_7$, $Y_2Sn_2O_7$, $Y_2Zr_2O_7$, $Y_2Ge_2O_7$, $Y_2Ru_2O_7$, $Y_2Os_2O_7$, $Y_2Ir_2O_7$, $Ce_2Ti_2O_7$, $Ce_2Sn_2O_7$, $Ce_2Zr_2O_7$, $Ce_2Ge_2O_7$, $Ce_2Ru_2O_7$, $Ce_2Os_2O_7$, $Ce_2Hf_2O_7$, $Ce_2Ir_2O_7$, $In_2Ge_2O_7$, $In_2Sn_2O_7$, $La_2Pt_2O_7$, $Y_2Pt_2O_7$, $Pr_2Zr_2O_7$, $Nd_2Zr_2O_7$, $Nd_2Sn_2O_7$, $Sm_2Zr_2O_7$ and $Sn_2Sm_2O_7$.

9. The method of claim 1, wherein the electronic conductive oxides ceramics is a scheelite structure oxide selected from the group consisting of $ZrGeO_4$, $ThGeO_4$, $ZrSnO_4$, $LaTaO_4$, $LaNbO_4$, $YTaO_4$ and $YNbO_4$.

10. A method according to claim 1, wherein said composition includes at least 75% by weight of electronic conductive oxide ceramics.

11. The method of claim 1, wherein said electronic conductive oxide ceramic is a delafossite structure oxide selected from the group consisting of $PbCoO_2$ and $PtCoO_2$.

12. The method of claim 1, wherein said electronic conductive oxide ceramic is a pyrochlore structure oxide selected from the group consisting of $La_2Sn_2O_7$ and $La_2Zr_2O_7$.

13. The method of claim 1, wherein said electronic conductive oxide ceramic is a Scheelite structure oxide selected from the group consisting of $ZrGeO_4$, $ZrSnO_4$, and $Zr(Ge_{0.4}Sn_{0.6})O_4$.

14. A method for producing aluminum by the molten salt electrolysis of aluminum oxide which comprises electrolyzing aluminum oxide dissolved in a molten salt containing aluminum sodium fluoride as the main component at a temperature of about 900° C. to about 1000° C. by passing a direct current therefor through an anode to a cathode disposed in said molten salt, wherein at least a portion of said anode that is brought into contact with said molten salt is made of or covered with a composition which includes at least about 50% by weight of electronic conductive oxide ceramics selected from one or a combination of oxides represented by general formulae $$\left\{\sum_{i=1}^{k}(Ai)Q_{Ai}\right\}\left\{\sum_{j=1}^{l}(Bj)Q_{Bj}\right\}O_3$$

where Ai and Bj are metal atoms, $Q_{Ai}$ and $Q_{Bj}$ are molar fractions of Ai and Bj constituents, respectively, O is an oxygen atom; K and l represent the numbers of metal constituents constituting Ai and Bj, respectively, and constituent ions at positions A and B meet the requirements of $$\sum_{i=1}^{k} Q_{Ai} = 1, \quad \sum_{j=1}^{l} Q_{Bj} = 1, \; O < Q_{Ai} \leqq 1,$$

$$O < Q_{Bj} \leqq 1 \text{ wherein if } Q_{Ai} = 1$$

$$\text{then } O < Q_{Bj} < 1 \text{ and if } Q_{Bj} = 1 \text{ then } O < Q_{Ai} < 1,$$

$$\sum_{j=1}^{k} Q_{Ai}\,1, \quad \sum_{j=1}^{k} Q_{Ai}n_{Ai} = \bar{n}_A,$$

$$\sum_{j=1}^{l} Q_{Bj}n_{Bj} = \bar{n}_B, \quad \bar{n}_A + \bar{n}_B = 6,$$

$$\sum_{i=1}^{k} \gamma_{Ai}Q_{Ai} = \bar{\gamma}_A, \quad \sum_{j=1}^{l} \gamma_{Bj}Q_{Bj} = \bar{\gamma}_B,$$

-continued $$0.8 < \frac{\bar{\gamma}_A + \gamma_o}{\sqrt{2}\,(\gamma_B + \gamma_o)} < 1.1$$

wherein $Q_A$ and $Q_{Bj}$ are molar fractions of the atoms, $n_{Ai}$ and $n_{Bj}$ are valences of the atoms, $\gamma_{Ai}$ and $\gamma_{Bj}$ are ion radii of the atoms, and $\gamma_o$ is ion radius of oxygen); $L_aO_b.Ta_2O_5$ wherein L is a divalent, trivalent or tetravalent metal, O is an oxygen atom, and if L is a divalent metal, then a=b=1, if L is a trivalent metal, then a=2, b=3, and if L is a tetravalent metal, then a=1, b=2; and $M_cO_d.Nb_2O_5$ wherein M is a divalent, trivalent or tetravalent metal, O is an oxygen atom, and if M is a divalent metal, then c=d=1, and if M is a trivalent metal, then c=2, d-3, and if M is a tetravalent metal, then c-1, d=2.

15. The method of claim 14, wherein at least that portion of the electrode base which is brought into contact with the molten salt bath is coated with the composition including at least about 50% by weight of electronic conductive oxide ceramics.

16. The method of claim 14, wherein at least that portion of the electrode which is brought into contact with the molten salt bath is entirely made of the composition including at least about 50% by weight of electronic conductive oxide ceramics.

17. The method of claim 14, wherein oxide, nitride, boride or silicide of an element selected from transition metal, platinum group metal and rare earth element is added to the electronic conductive oxide ceramics as an additive.

18. The method of claim 14, wherein conductivity of the electronic conductive oxide ceramics is at least 0.1 $\Omega^{-1}\,cm^{-1}$ at 1000° C.

19. The method of claim 14 wherein melting point of the electronic conductive oxide ceramics is at or above 1200° C.

20. The method of claim 14, wherein the electronic conductive oxide ceramics is a composite perovskite structure oxide selected from the group consisting of $La(Ni_{\frac{2}{3}}Ta_{\frac{1}{3}})O_3$, $La(Ni_{\frac{2}{3}}Nb_{\frac{1}{3}})O_3$, $La(Pd_{\frac{2}{3}}Ta_{\frac{1}{3}})O_3$, $La(Pd_{\frac{2}{3}}Nb_{\frac{1}{3}})O_3$, $Y(Ni_{\frac{2}{3}}Ta_{\frac{1}{3}})O_3$, $Y(Ni_{\frac{2}{3}}Nb_{\frac{1}{3}})O_3$, $Y(Pd_{\frac{2}{3}}Ta_{\frac{1}{3}})O_3$, $Y(Pd_{\frac{2}{3}}Nb_{\frac{1}{3}})O_3$, $Bi(Ni_{\frac{2}{3}}Ta_{\frac{1}{3}})O_3$, $Bi(Ni_{\frac{1}{2}}Zr_{\frac{1}{2}})O_3$, $La(Ni_{\frac{1}{2}}Pt_{\frac{1}{2}})O_3$, $La(In_{\frac{1}{2}}y_{\frac{1}{2}})O_3$, $La(In_{\frac{1}{2}}Al_{\frac{1}{2}})O_3$, $La(Pd_{\frac{1}{2}}Sn_{\frac{1}{2}})O_3$, $Y(Pd_{\frac{1}{2}}Sn_{\frac{1}{2}})O_3$, $Bi(Pd_{\frac{1}{2}}Sn_{\frac{1}{2}})O_3$, $(Ag_{\frac{1}{2}}Bi_{\frac{1}{2}})ZrO_3$, $(Ag_{\frac{1}{2}}Y_{\frac{1}{2}})SnO_3$, $(Ag_{\frac{1}{2}}La_{\frac{1}{2}})$ $(In_{\frac{1}{2}}Ta_{\frac{1}{2}})O_3$, $(Ag_{\frac{1}{2}}Bi_{\frac{1}{2}})$ $(In_{\frac{1}{2}}Nb_{\frac{1}{2}})O_3$, $La(Y_{\frac{1}{2}}Fe_{\frac{1}{2}})O_3$, $La(Y_{\frac{1}{2}}Mn_{\frac{1}{2}})O_3$, $La(Fe_{\frac{1}{2}}In_{\frac{1}{2}})O_3$ and $La(Fe_{\frac{1}{2}}Mn_{\frac{1}{2}})O_3$.

21. The method of claim 14, wherein the electronic conductive oxide ceramics is a rutile structure oxide selected from the group consisting of $CoO.Ta_2O_5$, $NiO.Ta_2O_5$, $ZnO.Ta_2O_5$, $SnO.Ta_2O_5$, $FeO.Ta_2O_5$, $Fe_2O_3.Ta_2O_5$, $Cr_2O_3.Ta_2O_5$, $Al_2O_3.Ta_2O_5$, $In_2O_3.Ta_2O_5$, $SnO_2.Ta_2O_5$, $TiO_2.Ta_2O_5$ and $ZrO_2.Ta_2O_5$.

22. The method of claim 14, wherein the electronic conductive oxide ceramics is a columbite structure oxide selected from the group consisting of $CoO.Nb_2O_5$, $NiO.Nb_2O_5$, $ZnO.Nb_2O_5$, $SnO.Nb_2O_5$, $FeO.Nb_2O_5$, $Fe_2O_3.Nb_2O_5$, $Cr_2O_3.Nb_2O_5$, $Al_2O_3.Nb_2O_5$, $In_2O_3.Nb_2O_5$, $SnO_2.Nb_2O_5$, $TiO_2.Nb_2O_5$ and $ZrO_2.Nb_2O_5$.

23. A method according to claim 14, wherein said composition includes at least 75% by weight of electronic conductive oxide ceramics.

24. The method of claim 14, wherein said electronic conductive oxide ceramic is a composite perovskite structure oxide selected from the group consisting of $LaY_{\frac{1}{2}}In_{\frac{1}{2}}O_3$ and $LaNi_{\frac{2}{3}}Ta_{\frac{1}{3}}O_3$.

25. The method of claim 14, wherein said electronic conductive oxide ceramic is a rutile structure oxide selected from the group consisting of $Fe_2O_3.Ta_2O_5$, $NiO.Ta_2O_5$, and $SnO_2.Ta_2O_5$.

26. The method of claim 14 wherein said electronic conductive oxide is the columbite structure oxide $NiO.Nb_2O_5$.

* * * * *